US006170755B1

(12) United States Patent
Schifferl

(10) Patent No.: US 6,170,755 B1
(45) Date of Patent: Jan. 9, 2001

(54) REDUCED RADIATED-NOISE RAIL

(75) Inventor: Herbert-Adolf Schifferl, Leoben (AT)

(73) Assignee: Voest-Alpine Schienen GmbH, Leoben-Donawitz (AT)

( * ) Notice: Under 35 U.S.C. 154(b), the term of this patent shall be extended for 0 days.

(21) Appl. No.: 08/913,931

(22) PCT Filed: Mar. 5, 1996

(86) PCT No.: PCT/AT96/00040

§ 371 Date: Jan. 7, 1998

§ 102(e) Date: Jan. 7, 1998

(87) PCT Pub. No.: WO96/30592

PCT Pub. Date: Oct. 3, 1996

(30) Foreign Application Priority Data

Mar. 24, 1995 (AT) ..... 527/95

(51) Int. Cl.[7] ..... F41C 33/02
(52) U.S. Cl. ..... 238/125; 238/150; 238/382
(58) Field of Search ..... 238/122, 125, 238/130, 150, 382

(56) References Cited

U.S. PATENT DOCUMENTS

| | | | |
|---|---|---|---|
| 717,845 | | 1/1903 | Haight . |
| 842,124 | | 1/1907 | Trimble . |
| 1,188,149 | | 6/1916 | Carney . |
| 3,525,472 | | 8/1970 | Sato . |
| 5,011,077 | * | 4/1991 | Hodgson et al. ..... 238/283 |

FOREIGN PATENT DOCUMENTS

| | | | |
|---|---|---|---|
| 1272950 | | 7/1968 | (DE) . |
| 881866 | | 5/1943 | (FR) . |
| 1198376 | | 12/1959 | (FR) . |
| 650711 | * | 2/1951 | (GB) . |
| 650722 | * | 2/1951 | (GB) . |
| 9500707 | * | 1/1995 | (WO) . |

OTHER PUBLICATIONS

"Modern Railway Track". Class 238, subclass 122, Esveld, Feb. 1990.*

* cited by examiner

*Primary Examiner*—S. Joseph Morano
*Assistant Examiner*—Andrew Wright
(74) *Attorney, Agent, or Firm*—Townsend and Townsend and Crew LLP

(57) ABSTRACT

The invention relates to a profiled rail (1), especially for a railway track, with a reduced total radiated noise level when in use. In order to reduce the noise radiation level, at least one web side surface (31) is substantially concavely rounded without any salient points in the lower region (31') between the transition edge (32) on the side of the rail patten (3) and the center of gravity axis (X) in the rail cross-section and/or the height (H) of the pattern is increased by comparison with a normally profiled rail having a corresponding total rail height A.

18 Claims, 3 Drawing Sheets

REDUCED RADIATED-NOISE RAIL

BACKGROUND OF THE INVENTION

The invention relates to a profiled rail, especially a railway rail, having a reduced total radiated noise level when in use, and comprising a foot section with a bottom surface, a web section, and a head section with a tread surface, and having a rail height and preferably also a rail head width, and in particular a moment of inertia and a section modulus about the axis of the center of gravity, corresponding substantially to those of standard, normally profiled rails having the same load-bearing capacity.

Running rails are profiled, rolled steel bars which are used to build trackways, especially railroad tracks, on which loads can be economically transported. On these tracks, metallic wheels, made preferably from steel or having a steel tire, run on the tread surface of a section of the rail referred to as the rail head. The foot of the rail, which is located opposite to and joined to the head by means of a web, is connected with its bottom surface to a base structure.

In the course of development of railway systems, functionally optimized cross-sectional profiles of rails were appropriately standardized for various loads and applications. In Europe, a frequently used standard profile for railroad rails bears the designation UIC 60; the rail weighs approx. 60 kg/m and tight dimensional tolerances of, for example, ±0.6 mm for the rail height and ±0.5 mm for the width of the rail head are specified. Tight tolerances in the rail profile are important, especially for the purpose of building a geometrically accurate track intended to permit the speed of trains to be increased without any loss in ride comfort and without any major dynamic loads occurring. In order to reduce wear, rails having heads exhibiting increased hardness are already being manufactured and used.

Despite the highest possible dimensional accuracy, a tread or running surface of the best quality, and smoothness of the rails, as railway cars travel along the track, vibrations, and thus radiated noise, occur. This airborne noise can attain high intensity, especially at high transportation speeds, and it can cause considerable environmental pollution. It has been found that the travel noise generated by trains is caused to a considerable extent by airborne noise radiated from the surface of the rail.

Attempts have already been made by sound-insulating surface sections of the rail to reduce the intensity of the radiated noise.

Applying a coating of vibration-damping material, as proposed in DE-A-4225581 or AT-AS 652/90, is only partially successful in achieving this goal; it is also expensive, prevents visual inspection of the rail in the track and, especially if reinforced polymers are used, it can itself be a source of environmental pollution. In addition, there have been several proposals, e.g. in DE-OS 4411833, to use elastic components in the fastening elements to reduce the transmission of vibrations to the base structure and thus to reduce the amount of airborne noise radiated from this source.

All the devices and arrangements so far proposed to reduce the airborne noise radiated from rails or track installations have in common the disadvantage that they are not very effective, and/or are very expensive, and are aimed essentially at reducing the transmission of vibrations from the rail.

SUMMARY OF THE INVENTION

It is therefore a purpose of the invention to reduce or shape the vibration of the rail, when it is travelled on by trains moving especially at high transportation speeds, so that the total level of radiated noise and the noise pollution of the environment are reduced. A particular goal of the invention is thus to reduce the vibrations of the body or the rail itself, which vibrations are responsible for generating the airborne noise, and thereby, in a simple manner, to reduce the radiated noise and the environmental pollution.

Using a profiled rail of the kind mentioned at the beginning, this task or goal is accomplished in that at least one lateral web surface, at least in the lower area between the transition edge at the foot of the rail, namely the edge formed at the transition from the foot into the lateral web surface, on the one hand, and the axis of the center of gravity, on the other hand, is concavely rounded and substantially free of any angularities in the cross section of the rail, and/or the height of the rail foot is larger compared with that of a standard profiled rail.

It has surprisingly been discovered that, contrary to what is assumed by experts in the field, it is not the web between the head and foot of the rail, vibrating like a membrane, that creates most of the radiated noise. Instead, the rail head and in particular the foot of the rail exhibit high solid-borne noise levels and thus contribute greatly to the level of the total sound pressure, and they in turn are chiefly responsible for the noise pollution of the environment. The reasons for the increased wave-like vibration in the longitudinal direction, i.e. the springiness, as a function of the frequency, for example, of one flange of a rail foot have not yet been scientifically fully explained. However, it is assumed that angularities in the surface profile or discontinuous changes in the thickness of the cross section may act as vibration nodes or theoretical clamping points causing or permitting increased vibrations to occur in sections of the rail profile, for example in a flange of the rail foot. In the manner according to the invention, increasing the height of the foot of the rail and/or in particular ensuring the transition, without angularities, from the foot into the lateral surface of the web brings about a change in the vibrations in the area of the rail foot; as a result, the amount of airborne noise radiated by the surfaces of the rail foot into the environment and possibly to a base structure, which reflects this radiated noise, is reduced.

A further reduction in the radiated noise is achieved when the cross-sectional profile is designed symmetrically to the height axis, as a result of which the tendency for local vibration nodes to form in the profiled bar is further reduced.

If, as further advantageously provided, the lower part and the upper part of the lateral surface of the rail web between the transition edge at the foot of the rail and the transition edge at the head of the rail, namely the edge which is formed when the lateral surface of the rail head merges into the upper surface of the web, are designed so as to be concavely rounded and substantially free of angularities in the cross section of the rail, the formation of vibrations, especially in sections of the rail profile which as a result radiate airborne noise, is further reduced.

It may be further advantageous from the point of view of manufacturing or rolling the rail, as well as for the purpose of minimizing the weight, but especially also in order to reduce airborne noise emission, if in the cross section of the rail the lateral surface of the rail web is made up of a circularly and/or an elliptically shaped lower and upper part and possesses preferably a straight middle or intermediate section, merging tangentially with the aforesaid parts, and through this middle section passes the axis of the center of gravity. It may be favorable in this case if the minimum thickness of the rail web is the same as or greater than that of standard rails.

A particularly favorable embodiment, in which the rail possesses a high load-bearing capacity while at the same time radiating a low level of airborne noise, is achieved if the distance between the axis of the center of gravity and the bottom surface at the foot of the rail has a value between (0.5 and 0.38), preferably between (0.47 and 0.41) times the height (A) of the rail.

The vibration sensitivity of the outer sections of the flanks of the rail foot can be largely eliminated or minimized in a simple way if the foot is less wide and/or higher compared with the respective standard rail profile.

If, as advantageously provided, the hardness of the material in the head, and in particular in the tread area of the rail according to the invention, has been increased, as is known in the art, it is possible to substantially reduce the resulting increase in the noise radiated by standard profiles if, in addition, the hardness of the material in the foot and in particular in the central area of the rail, which is arranged substantially symmetrically to the axis of the rail and contains the bottom surface, is also increased; in this way, a particularly stable embodiment possessing ideal functional properties is obtained.

BRIEF DESCRIPTION OF THE DRAWINGS

In the following, the invention is explained in more detail based on methods of implementation and test results schematically illustrated in the drawings.

DESCRIPTION OF THE PREFERRED EMBODIMENTS

Figure 1:
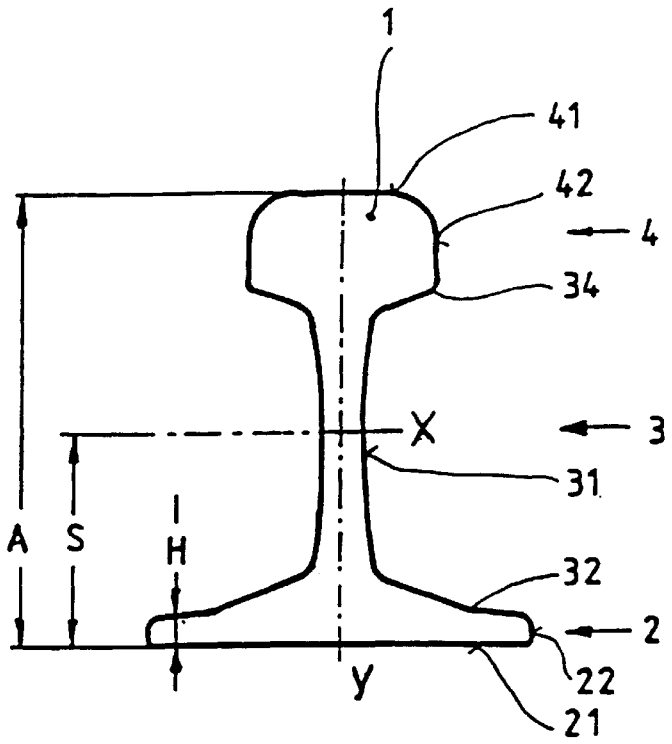
FIG. 1 is a cross section through a standard UIC 60 rail.

FIG. 1 shows a cross-sectional view of a standard UIC 60 rail. The rail has an overall height A of 172 mm, a head height of 37.55 mm from the tread surface 41 to the edge 34 where the transition is made to a lateral surface 31 of the web, and a foot width B of 150 mm. The distance S of the axis X of the center of gravity from the bottom surface 21 at the foot 2 of the rail is 80.95 mm.

Figure 2:
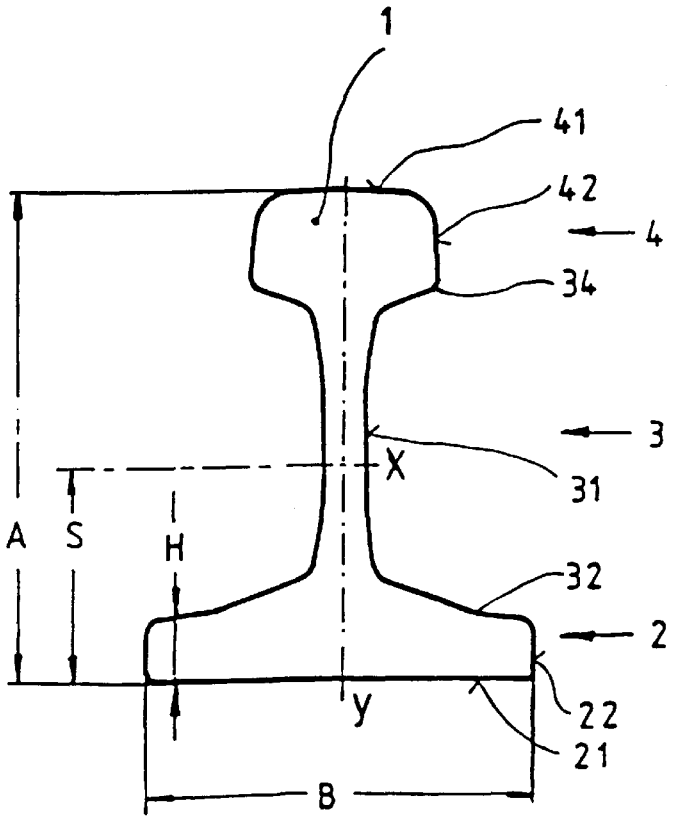
FIG. 2 is a cross section through a rail reinforced according to the invention in the foot area.
Figure 5:
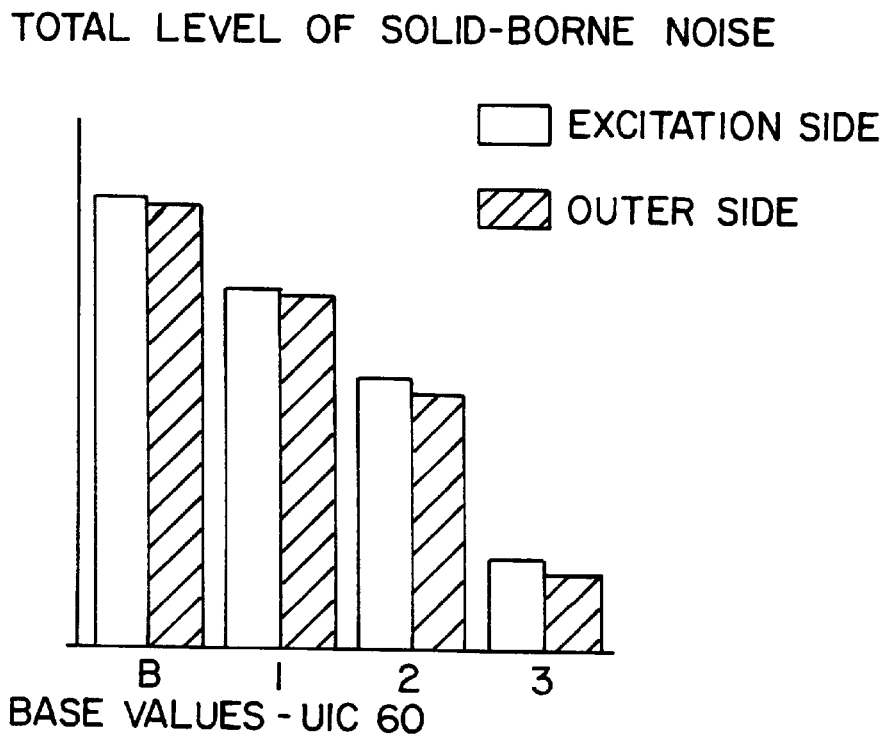
FIG. 5 depicts the total level of solid-borne noise and the weights of rails as a function of the cross-sectional shape.
Figure 5:
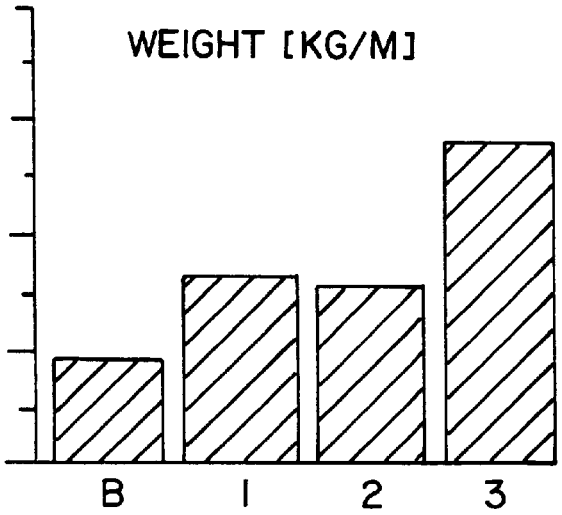

A standard UIC 60 rail of this type, having a weight or mass of 60.84 kg/m, was caused to vibrate by applying excitation in the form of impulses laterally or eccentrically at the tread surface 41, transverse to the longitudinal orientation, in a vertical and horizontal direction, and the maximum total level of solid-borne noise as well as the radiated sound power were determined. The values determined for a standard rail, as shown in FIG. 5, bar B, represent base values for the UIC 60 which can be compared with the values obtained from rails according to the invention. FIG. 2 depicts a rail according to the invention having a reinforced foot 2, or a larger foot thickness H, compared with a standard UIC 60 rail. As a result, while maintaining the same overall rail height A, the distance S between the axis (X) of the center of gravity and the bottom surface 21 is reduced and, as is also apparent from FIG. 5, bar 1, the weight of the rail is slightly increased. Compared with a standard rail, given the same excitation, this design leads to a reduction in the maximum total level of solid-borne noise and to a significant drop in the total level of airborne noise, as is also evident from FIG. 5, bar 1.

Figure 3:
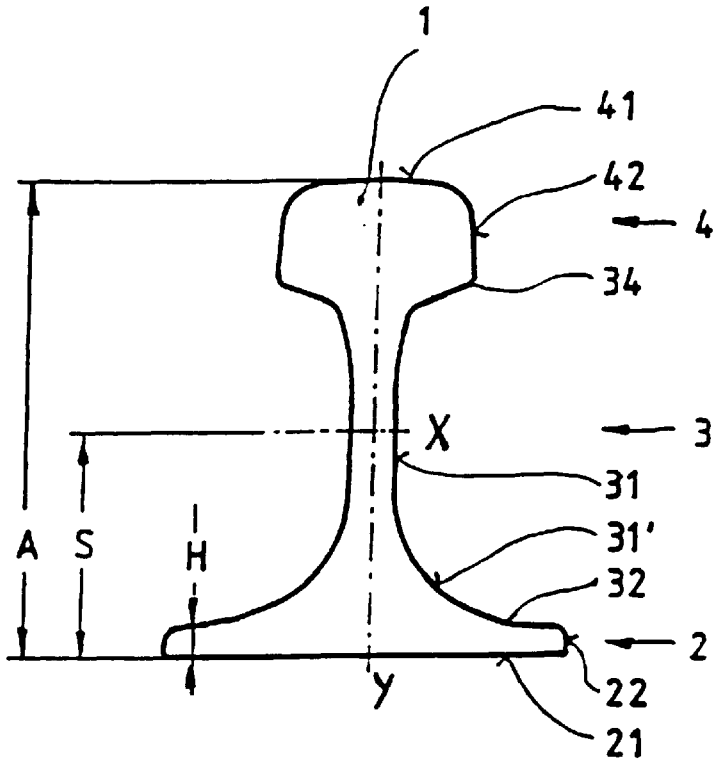
FIG. 3 is the cross section through a rail having rounded lateral web faces, free of angularities, at foot of the rail.

FIG. 3 shows a rail profile according to the invention in which the foot 2 has a height H corresponding to the standard UIC 60 profile, but in which the lower part 31' of the lateral surface 31 of the rail web 3, between the transition edge 32 at the foot and the intersection with the axis X of the center of gravity, has a symmetrical, circularly rounded configuration free of angularities. Compared with the standard rail, when the same pulsating excitation was applied, this embodiment was found to have a much reduced total level of solid-borne noise and a total level of radiated sound power that was lower by approximately 1.05 dB, as shown diagrammatically in FIG. 5, bar 2, while the mass of the rail (see lower part of FIG. 5, bar 2) was only slightly increased.

Figure 4:
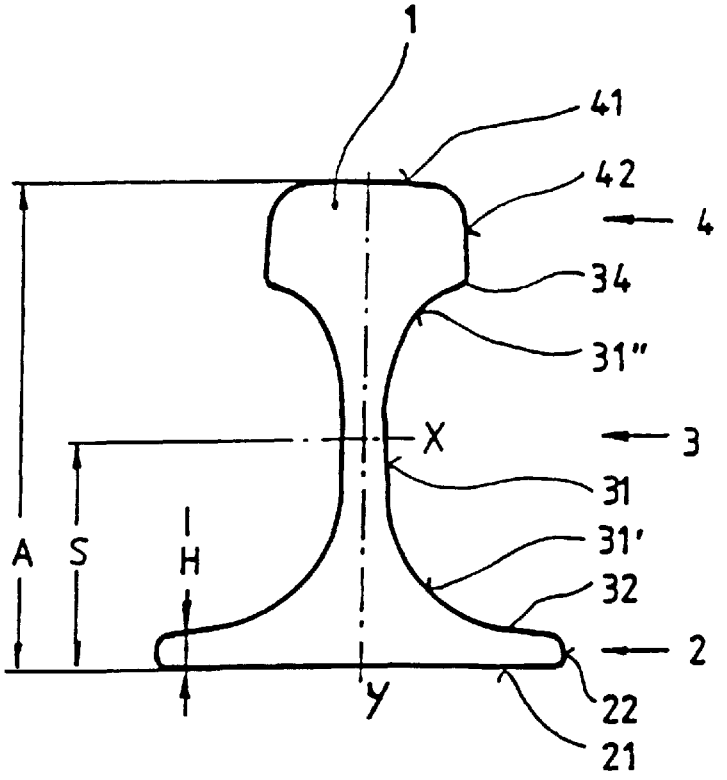
FIG. 4 is a rail cross section with fully rounded web surfaces.

FIG. 4 shows another rail profile according to the invention which possesses fully rounded fishing spaces, or lateral web surfaces 31 free of angularities, extending from the transition edge 32 at the foot of the rail to the transition edge 34 at the head of the rail, and having a plane-parallel middle section of the web 3 in the area of the axis of the center of gravity, said section merging tangentially into said surfaces. A continuous thickening of the web 3 towards the head 4 and the foot 5 of the rail increases the mass of the rail 1 per metre, as is evident from the lower part of FIG. 5, bar 3. As also shown by bar 3 in the upper part of FIG. 5, the maximum total level of solid-borne noise is reduced to a very small percentage compared with the standard UIC 60 profile, and also the total level of radiated sound power is reduced by about 3.0 dB.

Compared with other standard rail profiles, rails embodying the characteristics according to the invention also exhibited substantially lower total levels of radiated sound power.

What is claimed is:

1. A profiled rail having a reduced radiated noise level when in use comprising a foot section with a top surface, a web section with a lateral web surface, a head section with a tread surface, a rail height, and a moment of inertia and a section modulus about an axis extending through the center of gravity of the rail whose values correspond substantially to those of a standard profiled rail having the same load-bearing capacity, the rail having a cross-sectional profile formed symmetrically to a height axis of the rail and a concavely rounded lower lateral surface area extending from the top surface of the foot section to an intersection between the lateral web surface and the axis extending through the center of gravity, the concavely rounded lower lateral surface area being free of angularities in the cross-sectional profile of the rail.

2. A profiled rail according to claim 1 wherein the foot section of the rail has a height which is greater than that of the standard profiled rail.

3. A profiled rail according to claim 1 including a concavely rounded upper lateral surface area between an edge of the head section formed at a transition of the head section into the lateral web surface which is free of angularities in the cross-sectional profile of the rail.

4. A profiled rail according to claim 1 wherein, in the cross-sectional profile of the rail, the lateral web surface is defined by a circularly and/or elliptically shaped lower area and a circularly and/or elliptically shaped upper area.

5. A profiled rail according to claim 1 wherein a distance between the axis extending through the center of gravity and a bottom surface at the foot section of the rail has a value between 0.5 and 0.38 times the height of the rail.

6. A profiled rail according to caim 1 wherein a distance between the axis extending through the center of gravity and a bottom surface at the foot of the rail has a value between 0.47 and 0.41 times the rail height.

7. A profiled rail according to claim 1 wherein the foot section of the rail has a width which is narrower and/or a height which is greater than those of the standard profiled rail.

8. A profiled rail according to claim 1 wherein a portion of the rail defining the tread surface is harder than the web section or the foot section.

9. A profiled rail according to claim 1 wherein a portion of the rail including the foot section located essentially symmetrical to a height axis of the rail and containing a bottom surface of the foot section is harder than the web section.

10. A profiled rail according to claim 1 wherein the concavely rounded lower lateral surface area is tangent to the top surface of the foot section and to the lateral web section.

11. A profile rail according to claim 10 wherein the concavely rounded lower lateral surface is a circularly rounded surface.

12. A profile rail according to claim 11 wherein the circularly rounded surface has a radius which is greater than a width of the web section.

13. A profile rail having a reduced radiated noise level when in use comprising a head section with a tread surface, a foot section and a web section having a thickness and spaced-apart, lateral web surfaces and connecting the head section and the foot section, the foot section defining an upper surface on each side of the web section, and concavely rounded lower lateral surface areas extending tangentially from the respective upper surfaces of the foot section to the respective lateral web surfaces, being tangent to the lateral web surfaces where an axis extending through the center of gravity of the rail intersects the lateral web surfaces, and having a radius which is larger than the thickness of the web section.

14. A profiled rail having a reduced radiated noise level when in use comprising a foot section with an upper surface, a web section having a thickness and a lateral web surface, a head section with a tread surface, and having a rail height, and a moment of inertia and a section modulus about an axis extending through the center of gravity of the rail which correspond substantially to those of a standard profiled rail having the same load-bearing capacity, the rail having a cross-sectional profile formed symmetrically to a height axis of the rail and a circularly concavely rounded lower lateral surface area between the upper surface of the foot section and the lateral web surface which has a radius of curvature that is larger than the thickness of the web.

15. An improved profiled rail having a load carrying capacity, a reduction in radiated noise caused by wave-like vibrations of the improved rail when in use as compared to the radiated noise of a rail with substantially the same load carrying capacity and having a standardized shape and size, the improved rail comprising a foot section, a web section with a lateral web surface, and a head section with a tread surface, and having a rail height, with a rail head width and a moment of inertia and a section modulus about an axis extending through the center of gravity whose values correspond substantially to those of a standard profiled rail having the same load carrying capacity, the rail having a cross-sectional profile formed symmetrically to a height axis of the rail and a concavely rounded lower fillet surface which extends from the foot section to the lateral web surface and which has a radius that is greater than a thickness of the web, thereby reducing the radiated noise of the improved rail as compared to the noise caused by longitudinal vibrations in the rail with the standardized size and shape.

16. An improvement to a standard profiled rail for reducing noise generated by the rail, the standard rail having a standard profile, standardized dimensions, a given load carrying capacity, a rail head, a foot and a web interconnecting the head and the foot, the noise resulting from wave-like vibrations of at least one of the rail head and the foot in a longitudinal direction of the rail, the standard rail having a section modulus about an axis of its center of gravity, a standard foot with an upwardly facing standard foot surface that includes an angular transition spaced from a lateral end of the foot and dividing the upwardly facing standard foot surface into substantially flat portions having different angles relative to a bottom surface of the foot section, the improvement comprising a concavely rounded lower lateral transition surface between adjacent surfaces of the web and the foot which is free of angularities in the cross section of the rail and which extends beyond a circular line that is tangent to the lateral web surface and the upwardly facing foot surface and has a radius which is equal to a thickness of the web, whereby wave-like vibrations in the longitudinal direction of the rail are reduced as compared to the wave-like vibrations in the longitudinal direction generated by the standard rail.

17. An improvement to a standard profiled rail for reducing noise generated by the rail, the standard rail having a standard profile, standardized dimensions, a given load carrying capacity, a rail head, a foot and a web having a thickness interconnecting the head and the foot, the noise resulting from wave-like vibrations of at least one of the rail head and the foot in a longitudinal direction of the rail, the standard rail having a section modulus about an axis of its center of gravity, a standard foot with an upwardly facing standard foot surface that includes an angular transition spaced from a lateral end of the foot and dividing the upwardly facing standard foot surface into substantially flat portions having different angles relative to a bottom surface of the foot section, the improvement comprising a circularly rounded lower lateral transition surface between adjacent surfaces of the web and the foot which is tangent to the lateral web surface and the upwardly facing foot surface and has a radius which is greater than a thickness of the web, whereby wave-like vibrations in the longitudinal direction of the rail are reduced as compared to the wave-like vibrations in the longitudinal direction generated by the standard rail.

18. A method of reducing longitudinal vibrations in a standard rail having a predetermined shape and predetermined dimensions conforming to a preset standard, the standard rail defining a head, a foot, a web having a thickness and connecting the head and the foot, and a curved transition surface extending from the foot to the web, the method comprising the steps of:

providing a modified rail by forming a continuous transition extending from a lateral surface of the web to the foot which is free of angularities and, in a cross-section of the rail, extends beyond a circular line having a radius equal to the thickness of the web and being tangent to the lateral surface and an adjacent surface of the foot;

installing the modified rail on a railway track; and rolling railway vehicles over the modified rail of the railroad track;

whereby airborne noise generated by the modified rail when railway vehicles roll over it is reduced as compared to the airborne noise generated by the corresponding standard rail.

* * * * *